US007329993B2

(12) United States Patent
Fülöp

(10) Patent No.: US 7,329,993 B2
(45) Date of Patent: Feb. 12, 2008

(54) LAMP WITH INNER LAMP-STEM ASSEMBLY AND METHOD FOR MANUFACTURE

(75) Inventor: Gábor Fülöp, Fiumei út (HU)

(73) Assignee: General Electric Company, Schenectady, NY (US)

( * ) Notice: Subject to any disclaimer, the term of this patent is extended or adjusted under 35 U.S.C. 154(b) by 256 days.

(21) Appl. No.: 10/753,728

(22) Filed: Jan. 8, 2004

(65) Prior Publication Data

US 2005/0151478 A1 Jul. 14, 2005

(51) Int. Cl.
*H01J 61/33* (2006.01)
*F21V 19/00* (2006.01)

(52) U.S. Cl. ..... 313/634; 313/318.07

(58) Field of Classification Search ..... 313/318.07, 313/634

See application file for complete search history.

(56) References Cited

U.S. PATENT DOCUMENTS 5,126,619 A * 6/1992 Wakimizu et al. ..... 313/25
5,610,469 A * 3/1997 Bergman et al. ..... 313/25
6,084,352 A * 7/2000 Seki et al. ..... 313/635
6,163,102 A * 12/2000 Tucker et al. ..... 313/113
6,262,534 B1 7/2001 Johnson, Jr. et al.
6,400,077 B1 * 6/2002 Michel et al. ..... 313/578

FOREIGN PATENT DOCUMENTS

WO WO 02/33731 A2 4/2002

* cited by examiner

*Primary Examiner*—Joseph Williams
(74) *Attorney, Agent, or Firm*—Fay Sharpe LLP

(57) ABSTRACT

A lamp includes a lamp base with a stem having two leads. Free portions of the leads extend from the stem substantially parallel to each other and define a first plane. The lamp further includes a translucent outer envelope and a halogen inner lamp light source having a pinched end. The pinched end defines a second plane, and it is located in the vicinity of the stem. The first plane defined by the free portions of the leads is substantially perpendicular to the second plane defined by the pinched end.

15 Claims, 6 Drawing Sheets

LAMP WITH INNER LAMP-STEM ASSEMBLY AND METHOD FOR MANUFACTURE

BACKGROUND OF THE INVENTION

This invention relates to a lamp comprising a halogen inner lamp that is attached to a stem in the lamp.

Ordinary household lamps with an incandescent filament have been known for a long time. These lamps comprise a filament enclosed in a glass envelope or jacket. These lamps, while relatively cheap and reliable, are not energy-efficient. Compact fluorescent lamps have a higher efficiency, but they are more expensive, while many people perceive their spectrum as less natural. Therefore, it has been proposed to incorporate into a traditional glass bulb a smaller halogen light source, in the form of an inner lamp, having its own envelope and filament. Such inner lamps can be more efficient, because it is easier to maintain the ideal conditions for the heating of a filament within a small volume, surrounded by a relatively thick, and therefore strong envelope. Since it is a major objective to produce these lamps in a cost-effective manner, it is sought to use standard and proven lamp-manufacturing technology to the maximum possible extent. For this reason, the incorporation of the inner lamp into the larger glass envelope may be realized by attaching the inner lamp to a glass stem within the outer envelope. This glass stem traditionally serves multiple functions. Firstly, it includes the sealed leads that normally supply the electric current to the filament in the lamp. Secondly, the glass stem also contains the exhaust tube, through which the outer envelope is finally evacuated. Since these functions are also needed for a lamp with an inner lamp, it is desirable to maintain this functional element.

For example, U.S. Pat. No. 6,262,534 discloses a lamp with an external glass envelope and containing an inner lamp as a light source. There is also a protective shroud surrounding the inner lamp. The inner lamp and the shroud is connected to leads in a glass stem. The light source in U.S. Pat. No. 6,262,534 is a relatively short tungsten halogen incancdescent lamp having two outer leads exiting the lamp through a pinch. The leads are parallel to each other, and thereby define the plane of the pinch. The outer leads are sealed directly to the glass stem. Therefore, the main plane of the stem—as defined by the parallel leads within the stem—is parallel with the main plain of the pinch. However, this arrangement is only applicable with single-ended halogen inner lamps. Double-ended lamps are easier to manufacture, hence they are more preferred.

Another type of commercially available household lamp comprises an outer bulb enclosing an inner halogen lamp, supported by two leads in a glass stem. The inner halogen lamp is a double-ended lamp with two pinched ends. The inner lamp is attached to one of the leads with the help of a clamp, which is welded to one of the leads. The clamp is an essentially C-shaped and folded metal device, which clamps onto an edge of the pinch at one end of the C, and welded to the lead at the other end of the C. In this manner, the weight of the inner lamp is supported largely by the clamp. The disadvantage of this inner lamp-stem assembly is the relatively complicated shape of the clamp, and the fact that the pinch is relatively far from the stem.

International Patent Application No. WO 02/33731 discloses a lamp having a stem and an inner lamp connected to the stem. The inner lamp is a straight double-ended halogen lamp, with a straight filament and two leads which extend from a tubular inner lamp jacket at its two ends. The two ends are therefore sealed with a pinch in a known manner, sealing a connecting foil in the pinch. There is a pinch on both ends of the inner lamp. The leads of the halogen inner lamp are welded to external leads, and these latter are embedded in the stem of the lamp.

This latter arrangement has the advantage that a relatively cheap, mass-produced halogen light source may be incorporated into a standard light bulb, using largely the same manufacturing equipment which is used for manufacturing more traditional incandescent bulbs. Notably, the manufacturing equipment for producing the stem with leads, and the subsequent mounting of the external envelope to the stem may remain the same. The only difference is the light source itself, i.e. the use of an inner lamp (also termed as inner burner) instead of a free-standing filament. Though in some applications it would be desirable to have shorter double-ended inner lamps, it contradicts with certain other criteria. Firstly, in order to be able to generate a suitable light output, such a double-ended halogen lamp must have a filament reaching a certain length, but the length of the filament is limited by the length of the lamp, due to a number of technical considerations. Generally, the longer the filament, the higher the achievable light output. Secondly, there is also a practical lower limit to the size of double-ended inner lamps with pinched ends. Since the two pinches take up approx. 10-15 milimeters from both ends, the effective length of the filament is approx. half of that of the whole bulb. Therefore, double-ended inner lamps usually have a length above 50-55 milimeters, which is difficult to reduce further. For example, a 10% shorter bulb will mean a 20% decrease in the effective filament length, due to the more or less fixed length of the pinches. However, the incorporation of a longer straight inner lamp into the lamp may cause problems. Specifically, it may be problematic to incorporate a double-ended halogen lamp into a smaller lamp, such as a standard B-35 candle lamp.

Therefore, there is a need for relatively small lamps which incorporate a relatively long inner lamp, while keeping the small form factor of the lamp. Also, there is a need for a lamp which may be sold as a standard household lamp, which is easy to manufacture and which, at the same time, incorporates a halogen inner lamp. There is also need for an improved inner lamp—stem configuration which support the above goals. It is sought to provide a household lamp, which has a relatively simple structure, and which does not require any radical change in exisiting manufacturing facilities.

SUMMARY OF THE INVENTION

In an embodiment of the present invention, there is provided a lamp comprising a lamp base with a stem, where the stem comprises two leads. A free portion of the leads extends from the stem and defines a first plane. The lamp also comprises a translucent outer envelope and a halogen inner lamp light source. The inner lamp light source has a pinched end, which defines a second plane. The pinched end is located in the vicinity of the stem. The first plane defined by the leads is perpendicular to the second plane defined by the pinch.

In an embodiment of another aspect of the invention, there is also provided a method for manufacturing a lamp. The method is suitable for the manufacture of a lamp having an inner lamp, which is covered by an outer envelope, and where the lamp has a lamp base with a stem comprising two leads, so that a free portion of the leads extends from the stem and defines a first plane. The method is applicable for such lamps where the inner lamp comprises a pinched end, which pinched end defines a second plane. The method comprises the steps of attaching the inner lamp directly or indirectly to the stem, while connecting inner leads of the inner lamp to the leads in the stem and subsequently sealing the outer envelope to the stem. In the method, the step of attaching the inner lamp to the stem further comprises the step of positioning the pinched end of the inner lamp with the second plane substantially perpendicularly to the first plane, and the step of attaching the pinched end to the free portion of a lead.

The disclosed lamp may be manufactured in relatively compact sizes, due to the fact that the pinched end may be very closed to the stem, so the overall length of the inner lamp-stem assembly is reduced. This also facilitates the attachment of the pinched end directly to a lead in the stem, so that no mechanical load is exerted on the inner leads of the lamp, thereby making it possible to use relatively thin inner leads for the inner lamp. At the same time, most components of the lamp may be manufactured with a relatively simple, standard lamp manufacturing equipment, and also the inner lamp may have a simple and cheap structure. The proposed inner lamp-stem construction is mechanically more stable, and it is resistant against vibration.

BRIEF DESCRIPTION OF DRAWINGS

The invention will be now described with reference to the enclosed drawings, where.

DETAILED DESCRIPTION OF THE INVENTION

Figure 1:
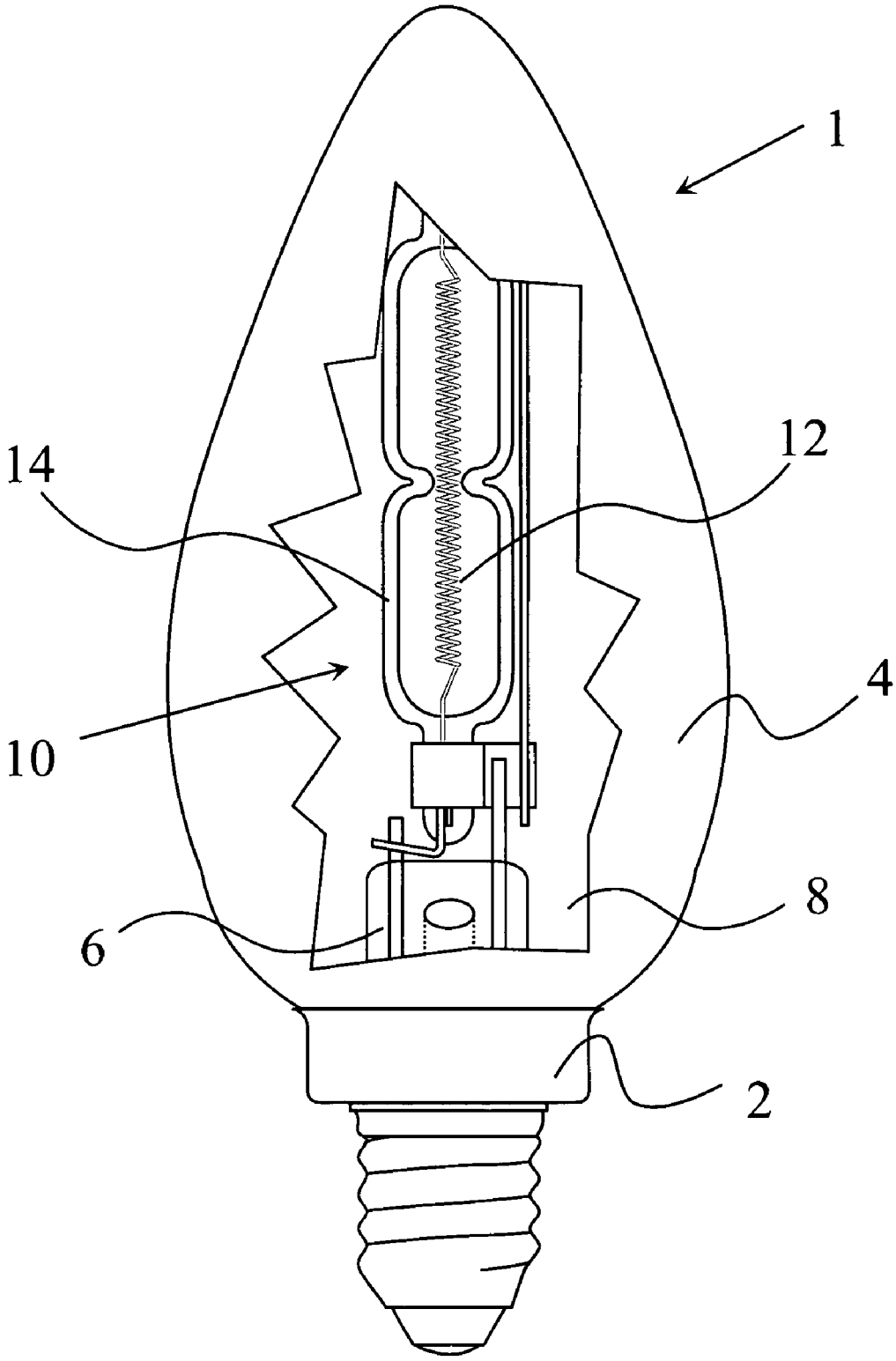
FIG. 1 is a side view of a lamp with a translucent, but not fully transparent outer envelope, showing the inner lamp within the outer envelope partly broken out.
Figure 2:
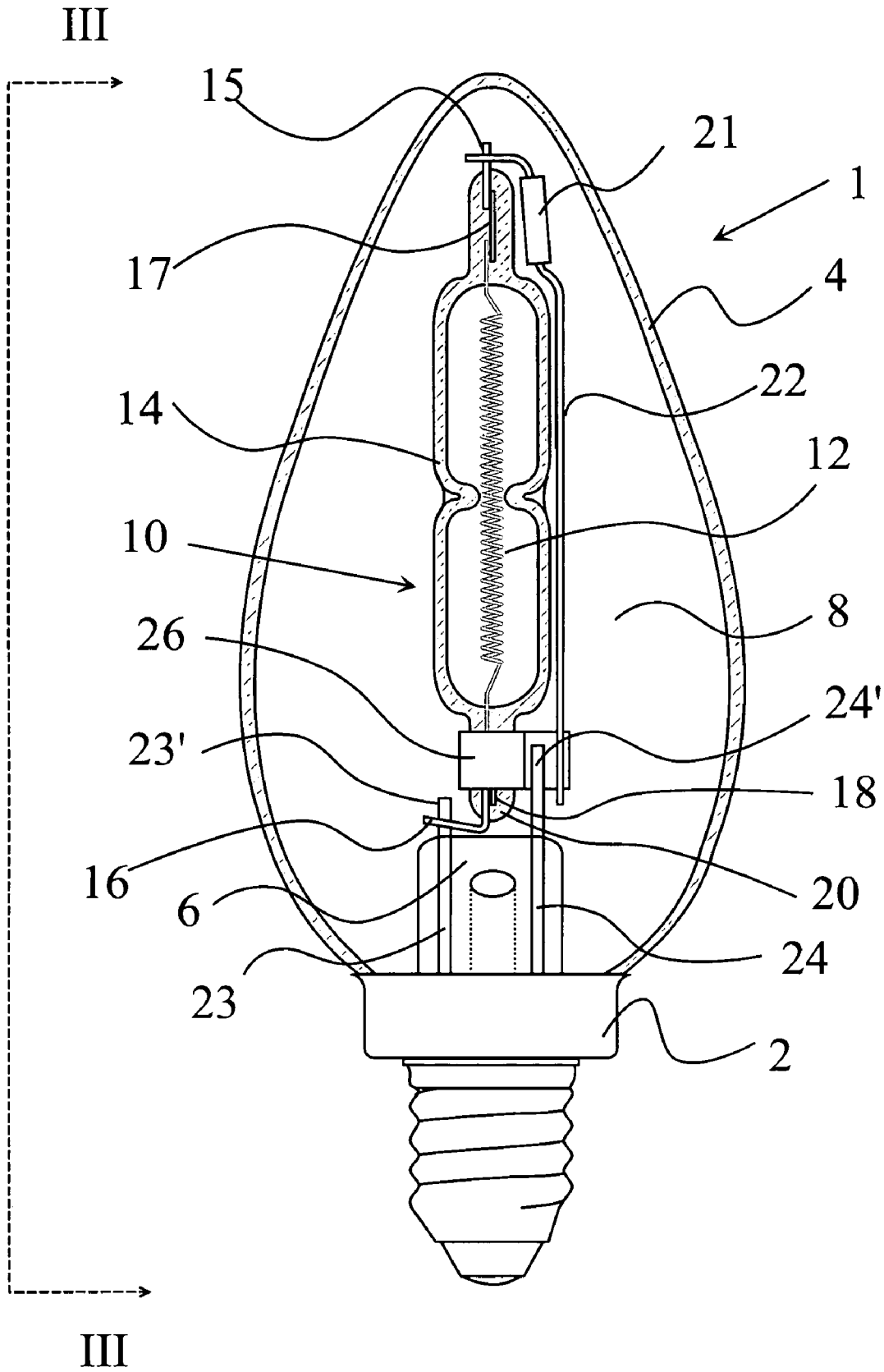
FIG. 2 is a first side view of a lamp similar to FIG. 1, in which the outer envelope and the inner lamp within the outer envelope shown in cross section.
Figure 3:
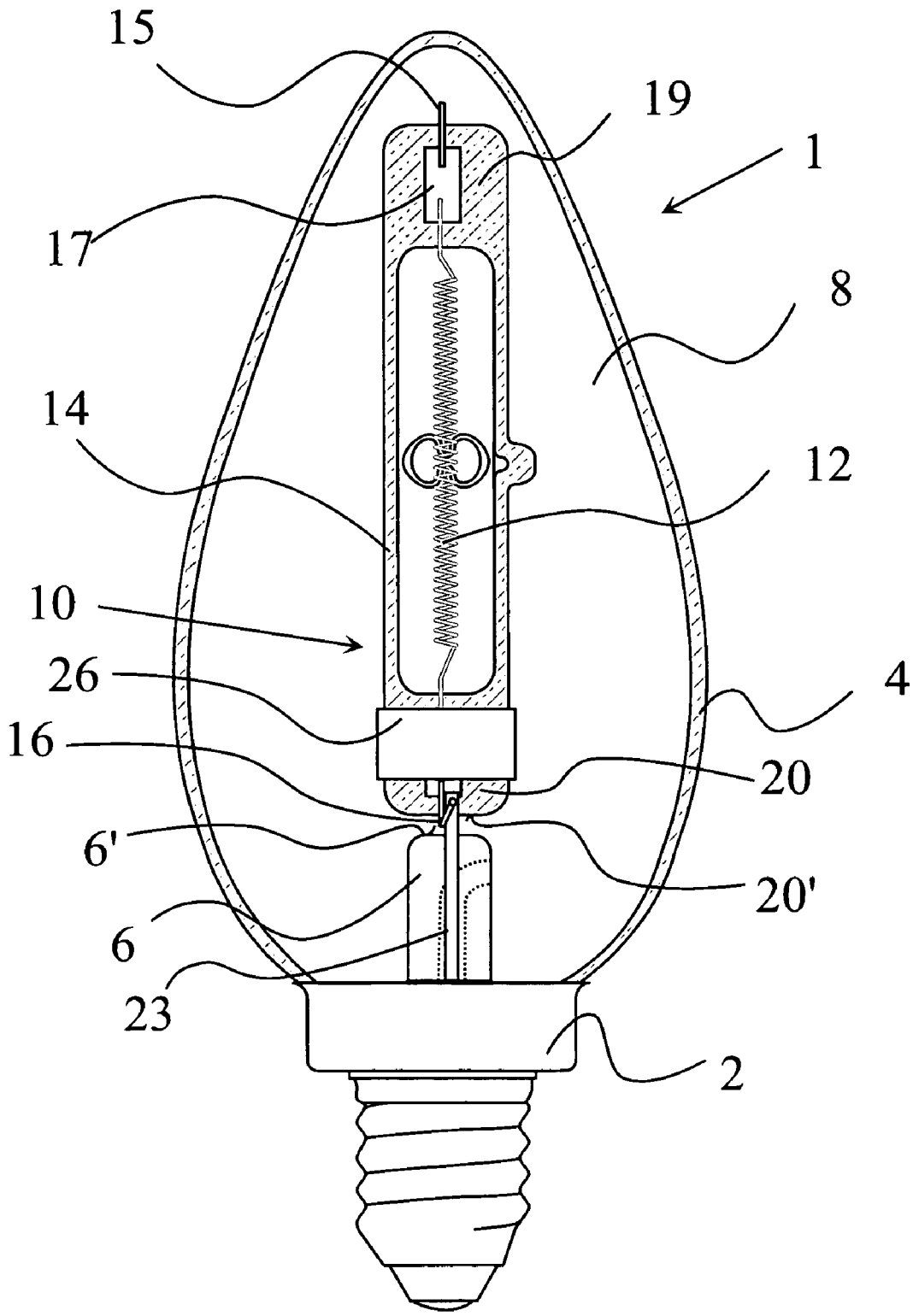
FIG. 3 is a second side view of the lamp of FIG. 2, seen from the direction III-III as illustrated in FIG. 2., and the outer envelope and the inner lamp are again shown in cross section.

Referring now to FIGS. 1 to 3, there is shown a lamp 1 in the form of a standard household lamp, in the shown embodiment a candle lamp according to the standard B 35. The lamp 1 is equipped with a lamp base 2 and a translucent outer envelope 4. The lamp base 2 is connected to a stem 6 and the outer envelope 4. Though not shown in detail, the stem 6 and the outer envelope 4 are sealed in a region covered by the lamp base 2, hermetically sealing an inner volume 8 surrounded by the outer envelope 4. A halogen inner lamp 10 functions as the actual light source within the lamp 1. This halogen inner lamp 10 contains a filament 12 in a halogen gas atmosphere, which latter is sealed within an inner lamp jacket 14. The filament 12 is connected to inner leads 15, 16 through conductor foils 17, 18 (see also FIG. 4). These conductor foils 17, 18 are acting as the sealed lead-through conductors. The material of the foil is mostly molybdenum. The conductor foils 17, 18 are embedded in pinched ends 19, 20 of the inner lamp jacket 14. Due to the low thickness of the foils, the softened glass can completely flow around the foils during the pinching, and a reliable, long-term sealing of the inner lamp jacket 14 is achieved. This structure of a pinched end is known itself.

The inner leads 15, 16 of the inner lamp 10 are connected to the leads 23, 24 in the stem 6 in the geometric arrangement as explained below. The connection is an electrical (and typically also a mechanical) connection, such as point welding. In the embodiment shown in FIGS. 1 to 6, the inner lamp 10 has two pinched ends 19, 20, located at the two ends of a halogen inner lamp 10 having a substantially straight jacket 14. In certain embodiments, such as the embodiment shown in FIG. 2, a fuse 21 is connected between an inner lead 15 and the associated lead 24, in the present case through a connecting wire 22.

Figure 4:
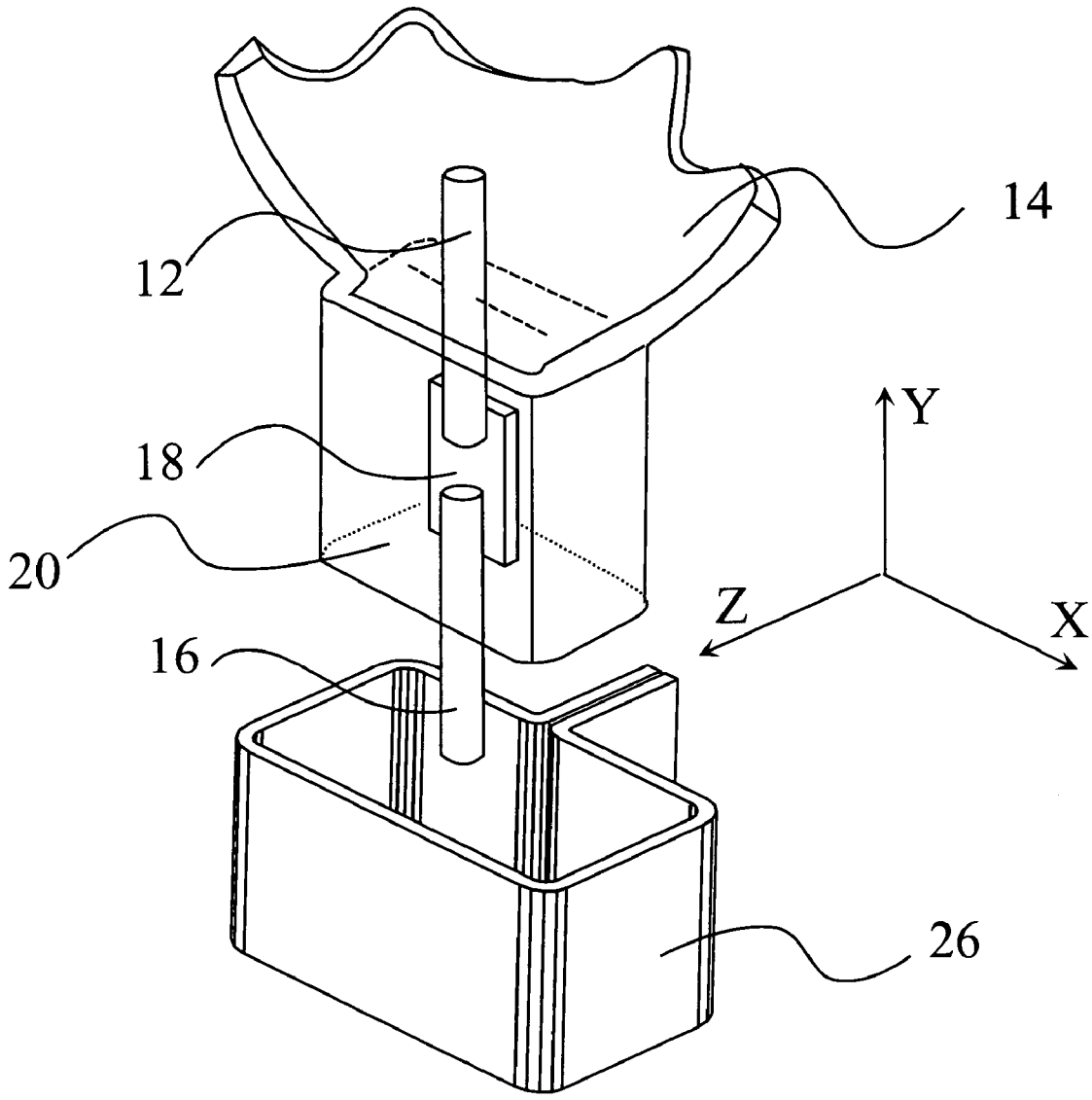
FIG. 4 illustrates the structure of the pinched end of the inner lamp and the strap surrounding the pinched end in an enlarged scale.
Figure 5:
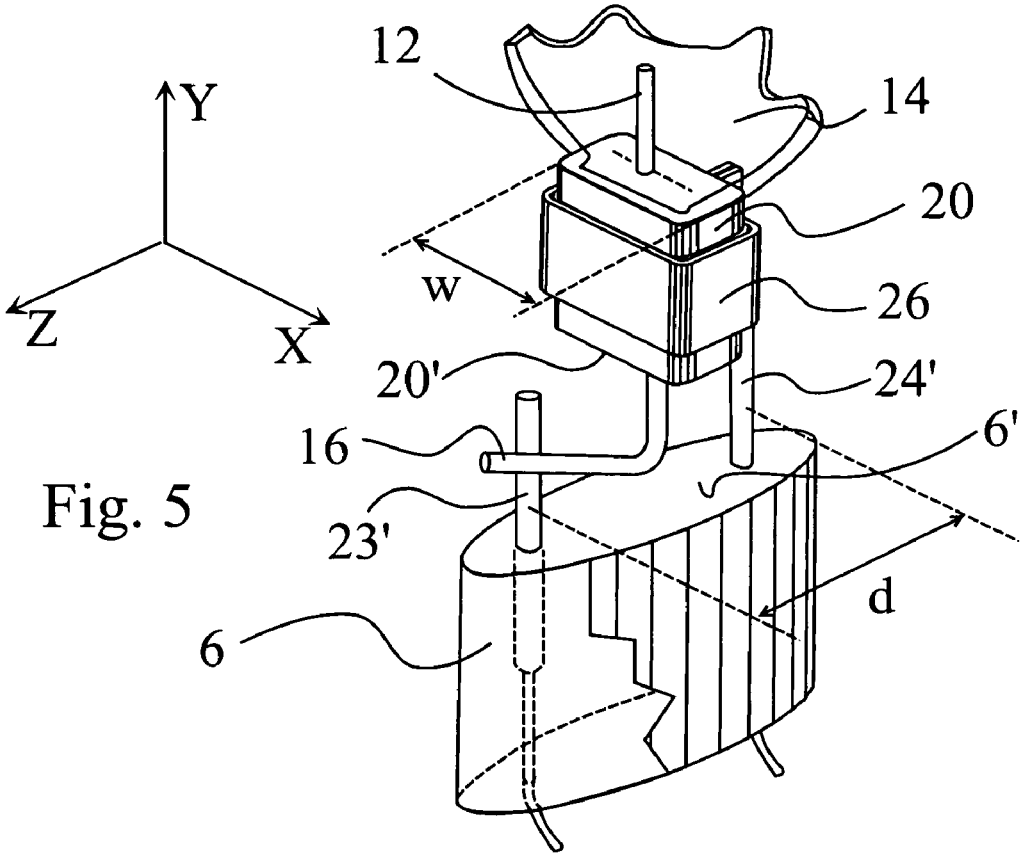
FIGS. 5 and 6 illustrate the pinch—stem assembly on an enlarged scale in a perspective view.
Figure 6:
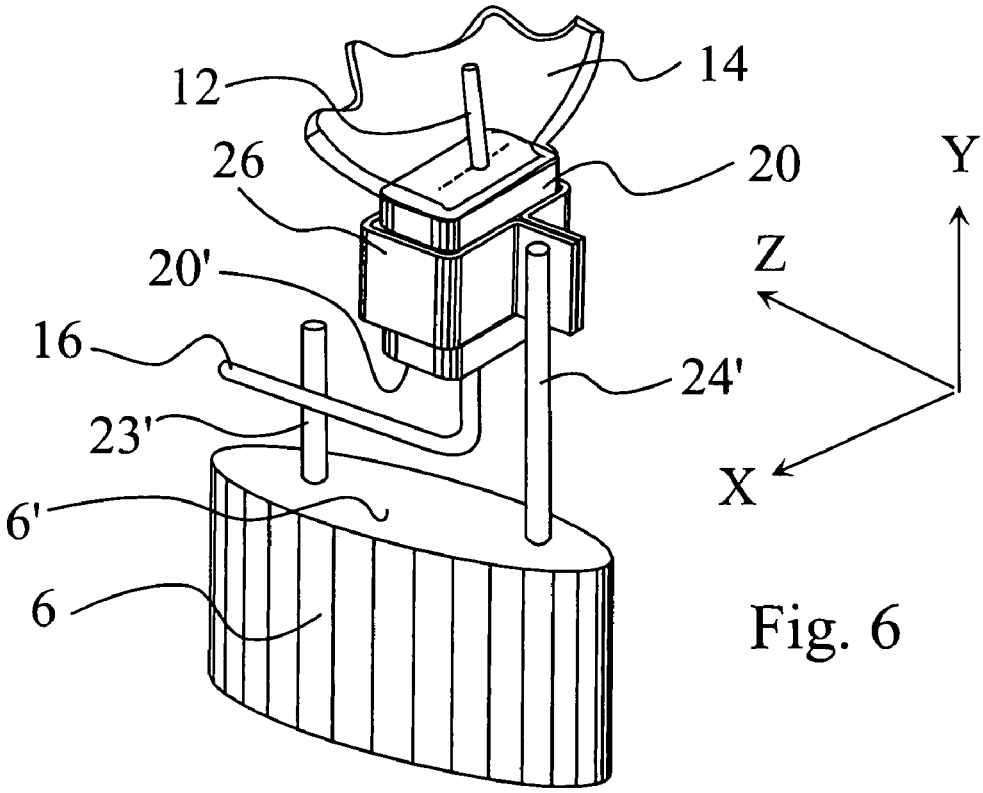

As a result of the pinching, the pinched ends 19, 20 are substantially flat, and thereby they have a well-defined principal plane that is parallel to the main axis of the inner lamp 10. Actually, the plane of the conductor foils 17,18 also determine the principal plane of the pinched ends 19,20, because in practice, appropriate sealing around the conductor foils 17,18 is only achievable if the plane of the conductor foils 17,18 is parallel to the principal plane of the final pinched ends 19,20. For example, in FIG. 2, the plane of the pinched ends 19, 20 is perpendicular to the plane of the drawing, while in FIG. 3, the plane of the pinched ends 19, 20 is parallel to the plane of the drawing. In FIG. 4, the plane of the pinched end 20 is parallel to the X-Y plane.

The stem 6 of the lamp 1 comprises two leads 23, 24. In a known manner, the leads 23, 24 are embedded in the stem 6, and provide a sealed lead-through from the outside into the inner volume 8 within the outer envelope 4. The two free portions 23', 24' of the leads 23, 24 (see also FIGS. 5-6) extend from the stem 6. The two free portions 23', 24' are substantially parallel, and in this manner the two free portions 23', 24' also define a common plane, which substantially coincides with the principal plane of the stem 6, because the leads 23, 24 are sought to be positioned in a median plane of the stem 6. For example, the principal plane of the stem 6 is parallel to the plane of the drawing in FIG. 2, while it is perpendicular to the plane of the drawing in FIG. 3.

In order to make the complete inner lamp-stem assembly as short as possible, one of the pinched ends 19,20 of the inner lamp 10—in the shown embodiments the pinched end 20—is located in the vicinity of the stem 6, as close to the stem 6 as possible. As best perceived from FIGS. 5 and 6, the plane of the pinched end 20 (plane XY) is perpendicular to the plane of the stem 6 (plane YZ) as defined by the leads 23, 24. In this manner, the pinched 20 end may be inserted between the free portions 23', 24' of the leads 23, 24, even if the width w of the pinch 20 is larger than the distance d between the leads 23, 24. As a result, the distance between the lower edge 20' of the pinched end 20 and the upper surface 6' of the stem 6 can be minimal.

The proposed arrangement makes it possible to fasten the inner lamp 10 directly to one of the leads 23, 24, so that the inner leads 15, 16 need not be relied upon for mechanical support of the inner lamp 10, and thus may be made of a relatively thin wire. For the purposes of a mechanical supporting element, the pinched end 20 carries a strap 26. The strap 26 is made of a metal band or strip with a suitable thickness, for example a steel strip 5 mm wide and with a thickness of approx. 0.3 mm. The strap 26 is attached to the free portion of one of the leads 23, 24, in the present embodiment to the free portion 24' of lead 24, in a known manner, for example by point welding or spot welding.

As illustrated in the figures, the free portions 23', 24' have a different length, the free portion 23' of the lead 23 is shorter than the free portion 24' of the lead 24. The strap 26 is attached to the lead having a longer free portion, here the lead 24. The length difference between the free portions 23', 24' may play a role in preventing arcing between the strap 26 and the opposite lead.

Figure 7:
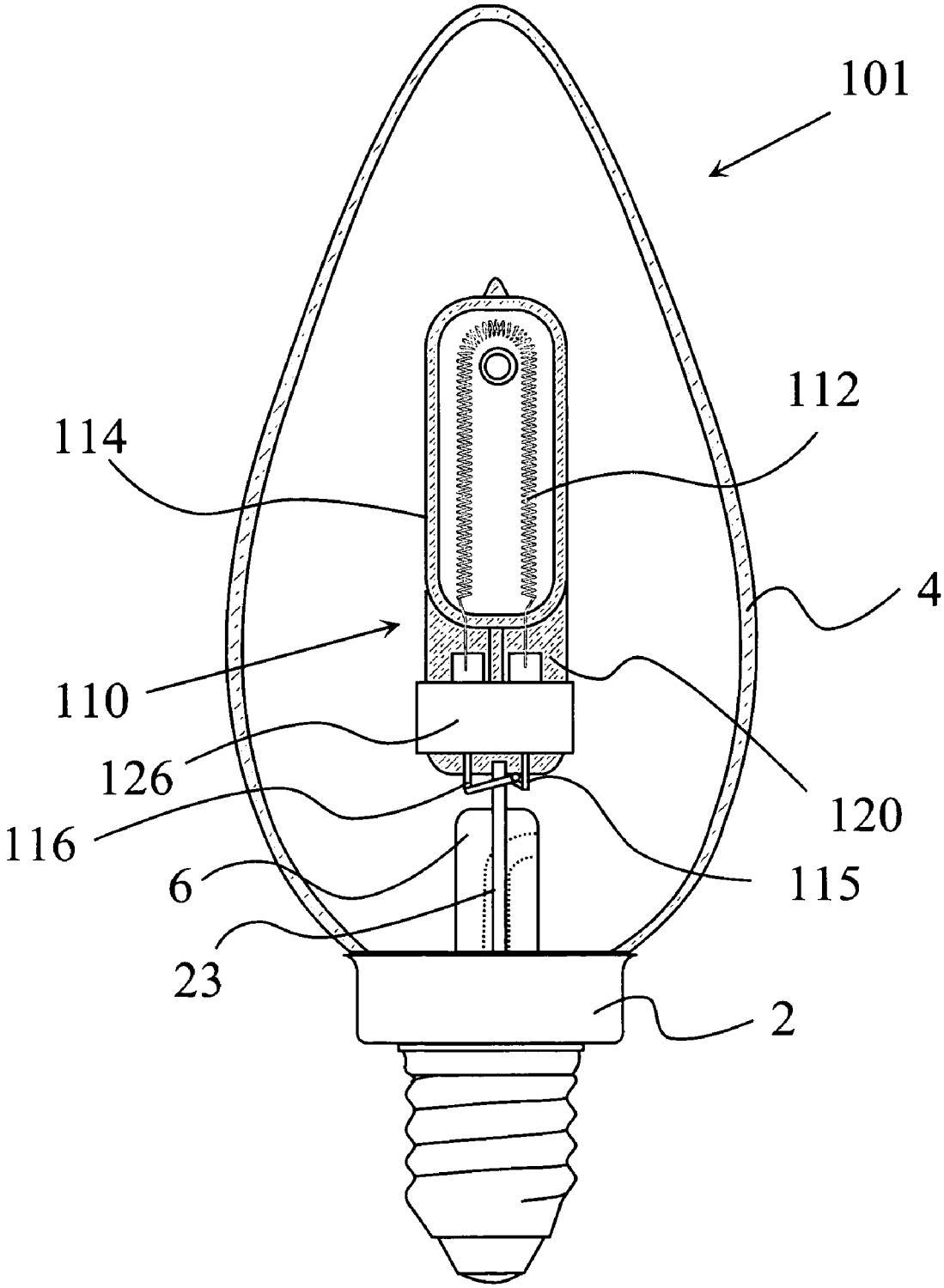
FIG. 7 is a side view of another embodiment of the lamp with a different inner lamp, in a partial cross section similar to FIG. 3.

FIG. 7 illustrates as a further embodiment the lamp 101. In this case, the inner lamp 110 is a shorter halogen burner, where a relatively long filament 112 is enclosed in a jacket 114. The jacket 114 has a single pinched end 120. The pinched end 120 encloses both inner leads 115,116 of the inner lamp 110, and, for this reason, the pinched end 120 is much wider than the pinched end 20 shown in FIGS. 1 to 6. However also in this case, the plane of the pinched end 120 is perpendicular to the plane of the stem 6, so that the pinched end 120 may be inserted between the free ends of the leads (only lead 23 is visible in FIG. 7). As in the previous embodiments, the inner lamp 110 is mechanically fastened to longer lead (not shown) with a strap 126, relieving the inner leads 115,116 from the mechanical load exerted by the weight of the inner lamp 110.

The lamps 1,101 may be manufactured in a straightforward manner using technological steps similar to those generally known for the manufacturing of lamps having an inner lamp covered by an outer envelope. The manufacturing of the stem 6 with the two leads is done in a known manner, producing a stem where a free portion of the leads extends from the stem. These two extending free portions define the principal plane of the stem. The free portions may be substantially symmetric, but preferably the free portions are trimmed to different lengths, either before or after the embedding of the leads in the stem. Typically, the leads in the stem have a reinforced terminal portion, so that the free portions and an adjacent portion embedded in the stem have a substantially larger diameter than the rest of the lead, ensuring the desired mechanical rigidity of the leads which must support the weight of the inner lamp. Conveniently, the stem can be made right from the start with leads that have reinforced terminal portion with different lengths.

Thereafter, an inner lamp is attached directly or indirectly to the stem. The inner lamp itself may be also produced in a known manner. However, the proposed method is applicable to such inner lamps that have at least one pinched end with a well-defined plane. Such inner lamps are typical halogen burners having a quartz jacket and enclosing Kr, Xe or Ar gas. As explained particularly with reference to FIGS. 5 and 6, the pinched end of the inner lamp is positioned with its primary plane being perpendicular to the plane of the stem. Advantageously, the pinched end of the inner lamp is than attached to the free portion of a lead, so that the weight of the inner lamp is supported directly by at least one of the leads. This is achieved by providing a mechanical connection between the pinched end and the lead. As explained above, the mechanical connection is established by providing a strap around the pinched end, and attaching the strap to the free portion of a lead. This mechanical connection substantially relieves any mechanical load from the inner leads of the inner lamp. However, such constructions are also possible where the mechanical connection between the inner lamp and the leads in the stem is provided solely by the inner leads of the inner lamp, simply by bending the inner leads towards the respective leads in the stem, and establishing a suitable bond between them, such as a welded bond.

The strap is put around the pinched end of the inner lamp. Before the latter is mechanically fastened to one of the leads, it is positioned between the free portions of the leads. Thereafter the strap is attached to the lead having a longer free portion.

Beside the establishment of a stable mechanical connection between the pinched end and the stem, the inner leads of the inner lamp are also connected to the leads in the stem, ensuring the electric connection between the contacts of the lamp base and the filament in the inner lamp.

Finally, the outer envelope is sealed to the stem, and the inner volume is evacuated and filled through an exhaust tube, in a known fashion. In a typical embodiment, the volume within the outer envelope contains nitrogen. As a last step, the lamp base is put onto the lower part of the stem, and the leads are connected to the external contacts of the lamp base.

The invention is not limited to the shown and disclosed embodiments, but other elements, improvements and variations are also within the scope of the invention. For example, it is clear for those skilled in the art that the proposed inner lamp-stem geometry is applicable not only with relatively small bulbs, but also with larger ones, for example if it is desired to bring the filament of the inner lamp as close to the stem as possible. The outer envelope and the inner lamp may also have numerous different forms and embodiments, such as various degrees of transparency or translucency. Also, the pinched end of the inner lamp may be fastened by other means to the lead, or to the stem directly.

The invention claimed is:

1. A lamp comprising a lamp base with a stem comprising two leads, a free portion of the leads extending from the stem substantially parallel to each other and defining a first plane, a translucent outer envelope, a halogen inner lamp light source having a pinched end defining a second plane, the pinched end being located in the vicinity of the stem, wherein the pinched end is inserted between the free portions of the leads, a lead through-foil electrically connecting one of the leads to the light source, the second plane defined by the pinched end being generally parallel with a third plane defined by the lead-through foil, the first plane defined by the free portions of the leads being substantially perpendicular to the second plane defined by the pinched end.

2. The lamp of claim 1, in which the free portion of a first lead has a length different from the free portion of a second lead.

3. The lamp of claim 1, in which the pinched end carries a strap attached to the free portion of one of the leads.

4. The lamp of claim 3, in which the strap is attached to one of the leads having a longer free portion.

5. The lamp of claim 1, in which the pinched end of the inner lamp comprises the lead-through foil.

6. The lamp of claim 1, in which the inner lamp comprises a further pinched end.

7. The lamp of claim 1, in which the pinched end encloses two inner leads.

8. A method for manufacturing a lamp having an inner lamp covered by an outer envelope, the lamp comprising a lamp base with a stem comprising two leads, with a free portion of the leads extending from the stem and defining a first plane, further the inner lamp comprising a pinched end defining a second plane, further the lamp comprising a lead-through foil defining a third plane.

comprising the steps of attaching the inner lamp directly or indirectly to the stem, while connecting inner leads of the inner lamp to the leads in the stem, the lead-through foil electrically connecting one inner lead to one stem lead, and subsequently sealing the outer envelope to the stem, the step of attaching the inner lamp to the stem further comprises the steps of positioning the pinched end of the inner lamp with the second plane substantially perpendicularly to the first plane, positioning the pinched end of the inner lamp with the second plane substantially parallel to the third plane, positioning the pinched end between the free portions, and attaching the pinched end to the free portion of a lead.

9. The method of claim 8, comprising the step of providing a mechanical connection between the pinched end and the lead, in which the mechanical connection substantially relieves any mechanical load from the inner leads of the inner lamp.

10. The method of claim 9, comprising the step of providing a strap around the pinched end, and attaching the strap to the free portion of a lead.

11. The method of claim 10, comprising the step of trimming the free portions to different lengths.

12. The method of claim 11, comprising the step of attaching the strap to the longer free portion.

13. A lamp comprising a lamp base with a stem comprising first and second extending leads, a first portion of the leads being received in the stem and a second free portion of the leads extending from the stem substantially parallel to each other and defining a first plane, the free portion of the first lead having a longer linear length than the free portion of the second lead;

a translucent outer envelope;

a halogen inner lamp light source having a pinched end and defining a second plane, the pinched end being located in the vicinity of the stem, wherein the pinched end is attached to the free portion of the first lead, and the pinched end is positioned below an end of the free portion of the first lead; and a lead through foil electrically connecting one of the leads to the light source and defining a third plane, wherein the first plane is generally perpendicular to the second plane, wherein the second plane is generally parallel with the third plane.

14. The lamp of claim 13, in which the pinched end includes a strap attached to the free portion of the first lead.

15. The lamp of claim 14, in which the strap is configured to substantially surround the pinched end.

* * * * *